US008437674B2

(12) United States Patent
Lee et al.

(10) Patent No.: US 8,437,674 B2
(45) Date of Patent: May 7, 2013

(54) HEATING MEMBER INCLUDING RESISTIVE HEATING LAYER, AND FUSING APPARATUS AND IMAGE FORMING APPARATUS INCLUDING THE HEATING MEMBER

(75) Inventors: Sang-eui Lee, Hwaseong-si (KR); In-taek Han, Seoul (KR); Ha-jin Kim, Hwaseong-si (KR); Sang-soo Jee, Hwaseong-si (KR); Dong-earn Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 292 days.

(21) Appl. No.: 12/846,009

(22) Filed: Jul. 29, 2010

(65) Prior Publication Data

US 2011/0116850 A1 May 19, 2011

(30) Foreign Application Priority Data

Nov. 18, 2009 (KR) ..... 10-2009-0111547

(51) Int. Cl.
*G03G 15/20* (2006.01)

(52) U.S. Cl.
USPC ..... 399/333

(58) Field of Classification Search ..... 399/122, 399/328–333; 428/36.9; 219/216, 619
See application file for complete search history.

(56) References Cited

U.S. PATENT DOCUMENTS 5,765,085 A * 6/1998 Law et al. ..... 399/329
5,900,295 A * 5/1999 Kawada ..... 428/36.9
7,273,095 B2 9/2007 Li et al.

FOREIGN PATENT DOCUMENTS

JP 05-278141 A 10/1993
JP 08-124661 A 5/1996
JP 2007-304374 A 11/2007

OTHER PUBLICATIONS

Huang, et al., Aligned Carbon Nanotube Composite Films for Thermal Management, Advanced Materials, Adv. Mater. 2005, 17, pp. 1652-1656.

* cited by examiner

*Primary Examiner* — Hoan Tran
(74) *Attorney, Agent, or Firm* — Cantor Colburn LLP

(57) ABSTRACT

A heating member includes a resistive heating layer disposed on an outermost layer of the heating member, where the resistive heating layer includes a conductive filler distributed in a base material and where the resistive heating layer emits heat when supplied with an electric current from an electrode, and a contacting unit which exposes the conductive filler of the resistive heating layer and contacts the electrode.

25 Claims, 6 Drawing Sheets

HEATING MEMBER INCLUDING RESISTIVE HEATING LAYER, AND FUSING APPARATUS AND IMAGE FORMING APPARATUS INCLUDING THE HEATING MEMBER

CROSS-REFERENCE TO RELATED APPLICATION

This application claims priority to Korean Patent Application No. 10-2009-0111547, filed on Nov. 18, 2009, and all the benefits accruing therefrom under 35 U.S.C.§119, the content of which in its entirety is herein incorporated by reference.

BACKGROUND

1) Field

The general inventive concept relates to a heating member including a resistive heating layer, and a fusing apparatus and an image forming apparatus including the heating member.

2) Description of the Related Art

An image forming apparatus for using an electrophotographic method typically forms a visible toner image on an image receptor by supplying toner to an electrostatic latent image formed on the image receptor, transferring the visible toner image to a printing medium, e.g., to a sheet of paper, and fusing the transferred toner image onto the printing medium. The toner may include various additives, such as a coloring agent or a resin, for example. The fusing process typically includes applying heat and pressure to the toner. The image forming apparatus using the electrophotographic method consumes a substantial amount of energy during the fusing process.

A fusing apparatus of the image forming apparatus typically includes a heating roller and a pressing roller that engage with each other to form a fusing nip. The heating roller may be heated by a heat source, such as a halogen lamp, for example. Thus, heat and pressure are applied to the toner image, which is transferred to the printing medium, e.g., the sheet of paper, while the printing medium passes through the fusing nip.

SUMMARY

The general inventive concept includes heating members which reduces contact resistance with an electrode which supplies electricity to a resistive heating layer, and fusing apparatus and image forming apparatus including the heating members.

In an embodiment, a heating member including a resistive heating layer disposed on an outermost layer of the heating member, where the resistive heating layer includes a conductive filler distributed in a base material and where the resistive heating layer emits heat when supplied with an electric current from an electrode, and a contacting unit which exposes the conductive filler of the resistive heating layer and contacts the electrode .

In an embodiment, the contacting unit may be formed by removing a portion of the surface of the resistive heating layer by using at least one method selected from the group consisting of a mechanical polishing method, a chemical mechanical polishing method, a wet chemical etching method, an electrochemical etching method and a dry plasma etching method. A thickness of the removed portion of the surface of the resistive heating layer may be greater than or equal to about 10 nanometers. A difference between a surface roughness of the resistive heating layer and a surface roughness of the contacting unit may be greater than or equal to about 10 nanometers.

In an embodiment, a length of the contacting unit may be equal to or greater than a length of the electrode. The contacting unit may be formed along an edge portion of the resistive heating layer in a longitudinal direction. A length of the electrode may correspond to a width of a width of the printing medium, and a length of the contacting unit may be equal to or greater than the length of the electrode. The electrode may be disposed outside the heating member.

In an embodiment, the heating member may further include a base which supports the resistive heating layer and an insulation layer disposed between the resistive heating layer and the base, and electrically insulates the resistive heating layer and the base.

In another embodiment, a heating member including a resistive heating including a base material and a conductive filler disposed in the base material, where a surface of the resistive heating layer includes a cut-out portion, and a contacting unit disposed within the cut-out portion of the surface of the resistive heating layer, where the contacting unit exposes the conductive filler and contacts an electrode which supplies a current to the resistive heating layer.

In an embodiment, the contacting unit may be formed by removing a portion of the surface of the resistive heating layer by using at least one method selected from the group consisting of a mechanical polishing method, a chemical mechanical polishing method, a wet chemical etching method, an electrochemical etching method and a dry plasma etching method. A cut-out height of the contacting unit with respect to the resistive heating layer may be equal to or greater than about 10 nanometers. A difference between a surface roughness of the resistive heating layer and a surface roughness of the contacting unit may be equal to or greater than about 10 nanometers.

In an embodiment, a fusing apparatus which fuses a toner image on a printing medium. The fusing apparatus includes a heating member including a resistive heating layer and a contacting unit, a nip forming member disposed opposite to the heating member and which forms a fusing nip, and an electrode which contacts the contacting unit and supplies a current to the resistive heating layer. The resistive heating layer is disposed on an outermost layer of the heating member, where the resistive heating layer includes a conductive filler distributed in a base material and where the resistive heating layer emits heat when supplied with an electric current from an electrode and the contacting unit exposes the conductive filler of the resistive heating layer and contacts the electrode .

In another embodiment, a fusing apparatus which fuses a toner image on a printing medium. The fusing apparatus includes a heating member including a resistive heating layer and a contacting unit, a nip forming member disposed opposite to the heating member and which forms a fusing nip, and an electrode which contacts the contacting unit and supplies a current to the resistive heating layer. The resistive heating layer includes a base material and a conductive filler disposed in the base material, where a surface of the resistive heating layer includes a cut-out portion; and the contacting unit is disposed within the cut-out portion of the surface of the resistive heating layer, where the contacting unit exposes the conductive filler and contacts an electrode which supplies a current to the resistive heating layer.

In an embodiment, an image forming apparatus including a printing unit which forms a toner image on a surface of a printing medium by using an electrophotographic process and a fusing apparatus which fuses the toner image on the printing medium by using heat and pressure. The fusing apparatus includes a heating member including a resistive heating layer disposed on an outermost layer of the heating member, where the resistive heating layer includes a conductive filler distributed in a base material and where the resistive heating layer emits heat when supplied with an electric current from an electrode and a contacting unit which exposes the conductive filler of the resistive heating layer and contacts the electrode, a nip forming member disposed opposite to the heating member and which forms a fusing nip, and an electrode which contacts the contacting unit and supplies a current to the resistive heating layer.

In another embodiment, an image forming apparatus including a printing unit which forms a toner image on a surface of a printing medium by using an electrophotographic process and a fusing apparatus which fuses the toner image on the printing medium by using heat and pressure. The fusing apparatus includes a heating member including a resistive heating layer including a base material and a conductive filler disposed in the base material, where a surface of the resistive heating layer includes a cut-out portion and a contacting unit disposed within the cut-out portion of the surface of the resistive heating layer, where the contacting unit exposes the conductive filler and contacts an electrode which supplies a current to the resistive heating layer, a nip forming member disposed opposite to the heating member and which forms a fusing nip, and an electrode which contacts the contacting unit and supplies a current to the resistive heating layer.

BRIEF DESCRIPTION OF THE DRAWINGS

The above and/or other aspects of this disclosure will become more readily apparent by describing in further detail non-limiting example embodiments thereof with reference to the accompanying drawings, in which.

DETAILED DESCRIPTION

Figure 1:
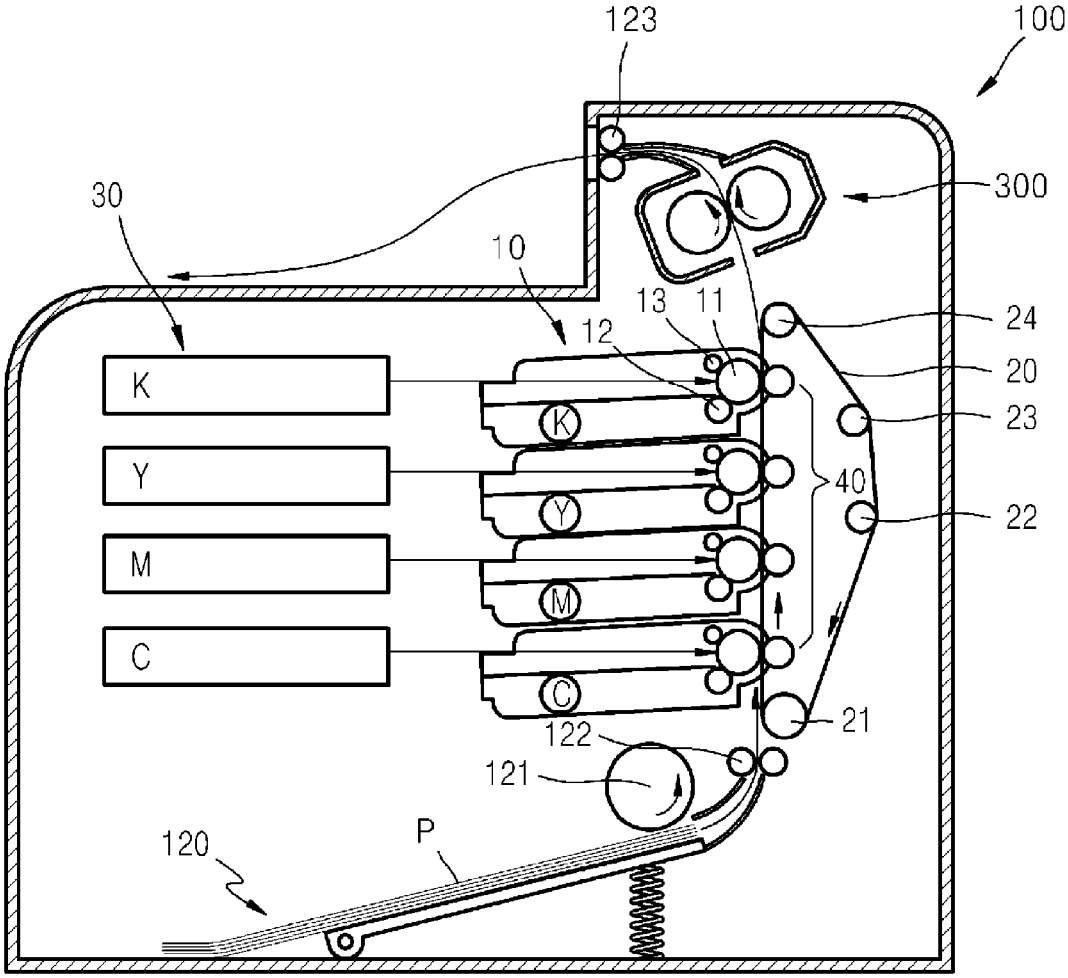
FIG. 1 is a block diagram of an embodiment of an image forming apparatus using an electrophotographic method.

The general inventive concept will now be described more fully hereinafter with reference to the accompanying drawings, in which various non-limiting example embodiments are shown. This invention may, however, be embodied in many different forms, and should not be construed as limited to the example embodiments set forth herein. Rather, these example embodiments are provided so that this disclosure will be thorough and complete, and will fully convey the scope of the invention to those of ordinary skill in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated regions, integers, steps, operations, elements, and/or components, but do not preclude the presence or addition of one or more other regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

One or more embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear portions. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a block diagram of an embodiment of an image forming apparatus using an electrophotographic method. The image forming apparatus of FIG. 1 may include a dry developer (also referred to as "toner") and print a color image by using a dry electrophotographic method.

Referring to FIG. 1, a printing unit 100 forms a toner image on a printing medium, e.g., a sheet of paper P, using an electrophotographic process. The printing unit 100 includes an exposure unit 30, a developer unit 10 and a transfer unit. In an embodiment, the printing unit 100 includes four developer units 10, each including one of four different color toners, for example, cyan ("C"), magenta ("M"), yellow ("Y") and black ("K") toners, and four exposure units 30 corresponding to the four developer units 10, respectively, to print a color image. Hereinafter, the four developer units 10 including one of the cyan ("C"), magenta ("M"), yellow ("Y") and black ("K") toner, respectively, s, will be referred to as 10C, 10M, 10Y, and 10K, respectively. Similarly, the four exposure units 30 corresponding to the four developer units referred to as 10C, 10M, 10Y and 10K respectively, will now be referred to as reference characters 30C, 30M, 30Y and 30K, respectively.

Each of the developer units 10C, 10M, 10Y and 10K includes a photoreceptor drum 11, which is an image receptor in which an electrostatic latent image may be formed on a circumference thereof, and a developer roller 12 that develops the electrostatic latent image. Each of the developer units 10C, 10M, 10Y and 10K may further include a charging roller 13. Each of the developer units 10C, 10M, 10Y, and 10K includes a charging roller 13, to which a charging bias voltage is applied and thereby the circumference of the photoreceptor drum 11 is charged to have a uniform electric potential. In another embodiment, a corona discharger (not shown) may be used, and the charging roller 13 may be omitted. Toner included in the each of the developer units 10C, 10M, 10Y and 10K is moved to the circumference of the developer roller 12, and the developer roller 12 supplies the toner to the photoreceptor drum 11 disposed adjacent thereto. A developing bias voltage is applied to the developer roller 12 when the developer roller 12 supplies the toner to the photoreceptor drum 11. In another embodiment, the developer units 10C, 10M, 10Y and 10K may further include a supply roller (not shown) that adheres the toner to the developer roller 12, a restriction unit (not shown) that restricts an amount of the toner adhered to the developer roller 12, and an agitator (not shown) that transfers the toner to the supply roller and/or the developer roller 12. In an embodiment, the developer units 10C, 10M, 10Y and 10K may further include a cleaning blade that removes the toner on the circumference of the photoreceptor drum 11 before start charging, and a storage space in which the removed toner may be stored.

Each of the exposure units 30C, 30M, 30Y and 30K radiates light corresponding to one of image information of cyan, magenta, yellow and black toward the photoreceptor drums 11 of the developer units 10C, 10M, 10Y and 10K. In another embodiment, a laser scanning unit ("LSU") including a laser diode as a light source may be used as the exposure units 30C, 30M, 30Y and 30K.

The transfer unit may include a medium conveyor belt 20 and four transfer rollers 40. The medium conveyor belt 20 faces the circumferences of the photoreceptor drums 11 exposed outside the developer units 10C, 10M, 10Y and 10K. The medium conveyor belt 20 rotates using support rollers 21, 22, 23 and 24 that support the medium conveyor belt 20. The four transfer rollers 40 face the photoreceptor drums 11 of the developer units 10C, 10M, 10Y and 10K, respectively, and the medium conveyor belt 20 is disposed between the four transfer rollers 40 and the photoreceptor drums 11. A transfer bias voltage is applied to the transfer rollers 40.

An embodiment of a color image forming process used in the image forming apparatus of FIG. 1 will now be described in detail.

The photoreceptor drums 11 of the developer units 10C, 10M, 10Y and 10K are charged to have a uniform electric potential by a charging bias voltage applied to the charging rollers 13. Electrostatic latent images are formed when the exposure units 30C, 30M, 30Y and 30K radiate lights corresponding to image information of cyan, magenta, yellow and black to the photoreceptor drums 11 of the developer units 10C, 10M, 10Y and 10K, respectively. A developing bias voltage is applied to the developer rollers 12. Accordingly, the toner disposed on the circumferences of the developer rollers 12 is transferred to the electrostatic latent images on the photoreceptor drums 11, and thus a cyan toner image, a magenta toner image, a yellow toner image, and a black toner image are formed on the photoreceptor drums 11 of the developer units 10C, 10M, 10Y and 10K, respectively.

The printing medium, e.g., the sheet of paper P, that accommodates the toner is taken out from a cassette 120 by a pickup roller 121. The printing medium, e.g., the sheet of paper P, is supplied to the medium conveyor belt 20 by a conveyor roller 122, and is transferred at the same speed as a moving speed of the medium conveyor belt 20 by being adhered to a surface of the medium conveyor belt 20 via electrostatic force.

In an embodiment, a front edge of the printing medium, e.g., the sheet of paper P, reaches a transfer nip disposed opposite to, e.g., facing, the transfer roller 40 when a front edge of the cyan toner image formed on the circumference of the photoreceptor drum 11 of the developer unit 10C including the cyan toner reaches the transfer nip. When a transfer bias voltage is applied to the transfer roller 40, the toner image formed on the photoreceptor drum 11 is transferred to the printing medium, e.g., the paper P. When the printing medium, e.g., the paper P, is transferred, the magenta toner image, the yellow toner image, and the black toner image formed on the photoreceptor drums 11 of the developer units 10M, 10Y, and 10K, respectively, are transferred to the printing medium, e.g., the sheet of paper P, and a color toner image is thereby formed on the printing medium, e.g., the sheet of paper P.

The color toner image formed on the printing medium, e.g., the sheet of paper P, is transferred to the surface of the printing medium, e.g., the surface of the paper P, via electrostatic force. A fusing apparatus 300 fuses the color toner image on the printing medium, e.g., the sheet of paper P, using heat and pressure. In an embodiment, the color toner image is fused on the printing medium, e.g., the sheet of paper P by heat and pressure, and the printing medium, e.g., the sheet of paper P, is discharged out of the image forming apparatus by a discharge roller 123.

Figure 2:
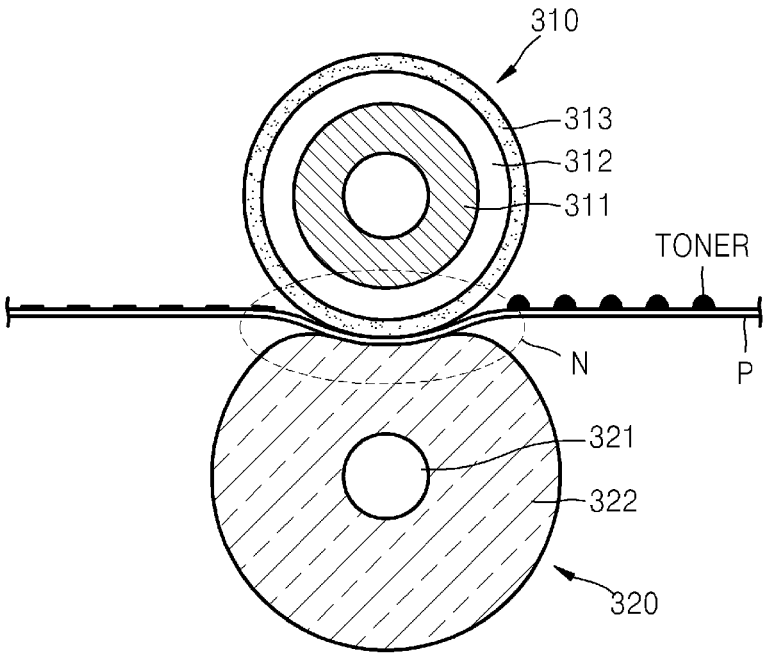
FIG. 2 is a cross-sectional view of a fusing apparatus of the image forming apparatus shown in FIG. 1.
Figure 3:
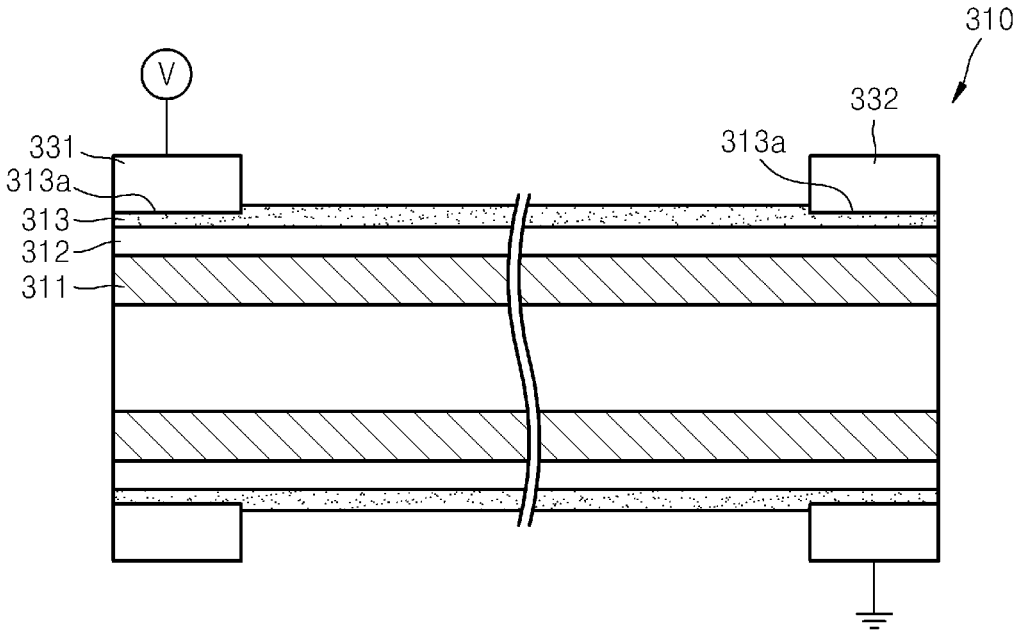
FIG. 3 is a cross-sectional view of the fusing apparatus shown in FIG. 2.
Figure 4:
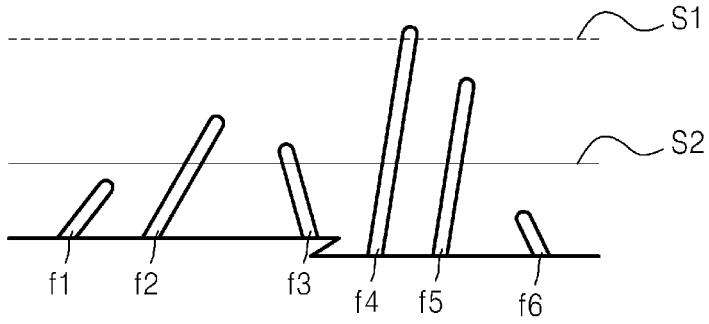
FIG. 4 is a diagram of an embodiment of a conductive filler exposed by a contacting unit.

FIG. 2 is a cross-sectional view of an embodiment of the fusing apparatus 300 of the image forming apparatus shown in FIG. 1, FIG. 3 is a cross-sectional view of a heating member 310 of the fusing apparatus 300 shown in FIG. 2, and FIG. 4 is a diagram of an embodiment of a conductive filler exposed by a contacting unit. As shown in FIG. 2, the fusing apparatus 300 includes the heating member 310 and a nip forming member 320 which forms a fusing nip N with the heating member 310 disposed opposite thereto. In an embodiment, the nip forming member 320 is in a roller-like shape and includes a metal core 321 and an elastic layer 322. In an embodiment, the heating member 310 and the nip forming member 320 may be biased toward each other by a bias unit (not shown), e.g., a spring. The fusing nip N that transfers heat from the heating member 310 to the toner on the printing medium, e.g., the sheet of paper P, includes a deformed portion of the elastic layer 322 of the nip forming member 320.

Referring to FIGS. 2 and 3, the heating member 310 includes a resistive heating layer 313, a base 311 that supports the resistive heating layer 313, and electrodes 331 and 332 that apply a voltage to the resistive heating layer 313. In an embodiment, the heating member 310 may be in the shape of a roller by including the base 311 as a cylindrical core. In an embodiment, the base 311 may be formed of a metal, and an insulation layer 312 that electrically insulates between the resistive heating layer 313 and the base 311 may be disposed between the resistive heating layer 313 and the base 311. In another embodiment, the base 311 may be formed of a highly thermostable plastic having stable mechanical characteristics at high temperatures, such as polyphenylene sulfide ("PPS"), polyimide-imide, polyimide, polyketone, polyphthalamide ("PPA"), polyether-ether-ketone ("PEEK"), polythersulfone ("PES"), polytherimide ("PEI") or a combination comprising at least one of the foregoing high heat-resistant plastics, for example. In another embodiment, the base 311 may be formed any material that has stable mechanical characteristics at operating temperatures of the fusing apparatus 300. When the base 311 is formed of a non-conductive material, such as a highly thermostable plastic, for example, the insulation layer 312 may be omitted. The insulation layer 312 may be formed of polymers having electrical insulating properties. In another embodiment, the insulation layer 312 may be formed of a highly thermostable plastic. In another embodiment, the insulation layer 312 may be formed of a polymer in the shape of a sponge or foam for insulation.

The heating member 310 may further include an elastic layer (not shown). In an embodiment, the base material of the resistive heating layer 313 may be a thermostable polymer having elasticity, and the resistive heating layer 313 thereby functions as the elastic layer. In another embodiment, the insulation layer 312 may be formed of a polymer having elasticity, and the insulation layer 312 thereby functions as the elastic layer.

In an embodiment, the heating member 310 including the resistive heating layer 313 is used as a heat source. The resistive heating layer 313 forms the outermost layer of the heating member 310. The resistive heating layer 313 may be formed by distributing a conductive filler (FIG. 4) into a base material. The base material may be any thermostable material at a fusing temperature. The base material may be elastic. In an embodiment, the base material may be a highly thermostable elastomer, such as a silicon based rubber, e.g., polydimethylsiloxane ("PDMS"). In another embodiment, the base material may be formed of a fluoropolymer-based material having excellent releasing properties, such as polytetrafluoroethylene ("PTFE"), for example, and an offset when the toner on the printing medium, e.g., the sheet of paper P, is moved to the surface of the heating member 310 is thereby effectively prevented.

When a voltage is applied to the resistive heating layer 313, Joule heat is generated. The conductive filler may be a metal-based filler, such as iron, nickel, cobalt, aluminum, gold, silver, or a combination comprising at least one of the foregoing metal-based fillers, for example, and/or a carbon-based filler, such as carbon nano-tubes, carbon black, carbon staple fiber, carbon filament, carbon coil, or a combination comprising at least one of the foregoing carbon-based fillers. The metal-based filler may have a needle shape, a plate shape, a circular shape or the like. In an embodiment, the resistive heating layer 313 may include a metal oxide, such as alumina or oxidized steel, for example, and thermal conductivity of the resistive heating layer 313 is thereby substantially increased. The conductive fillers may form a conductive network by being arranged randomly or in a certain direction in a base resin.

The electrodes 331 and 332 contact a portion of the surface of the resistive heating layer 313. The electrodes 331 and 332 contact the conductive filler exposed on the portion of the surface of the resistive heating layer 313. When a voltage is applied to the electrodes 331 and 332, a current flows in the conductive network formed by the conductive fillers, and Joule heat is thereby generated in the resistive heating layer 313. The electrodes 331 and 332 may be formed of a highly electrically conductive metal, for example, but not being limited thereto. In an embodiment, the electrodes 331 and 332 may be formed of transparent conductive materials, such as a indium tin oxide ("ITO") or indium zinc oxide ("IZO"), for example, electrically conducting polymers having excellent electric conductivity, such as poly-3, 4-ethylenedioxythiophene ("PEDOT") or polypyrrole ("PPy"), polyaniline, polyacetylene or a combination comprising one of the foregoing electrically conducting polymers, for example, or carbonaceous materials, such as carbon fibers, carbon nanotubes, carbon nano-fibers, carbon filaments, carbon coils, or carbon black, or any combination comprising at least one of the foregoing carbonaceous materials, for example.

In an embodiment, the fusing apparatus 300 is heated up to a temperature around a predetermined fusing temperature to fuse the color toner image on the printing medium, e.g., the sheet of paper P. A time spent on printing a first page after receiving a printing command may be reduced by reducing a heating time of the fusing apparatus 300. In a conventional image forming apparatus using an electrophotographic method, a fusing apparatus is generally heated only during a printing process, and the fusing apparatus does not operate during a standby period. Accordingly, when the printing process is to be performed after the standby period, the fusing apparatus is re-heated to perform the printing process. In an embodiment, the fusing apparatus may be controlled to maintain a constant temperature during a standby period to reduce time spent on the printing process after standby period. In an embodiment, when a time to raise the temperature of the fusing apparatus 300 up to the temperature at which the printing process is performed is substantially reduced, preheating during the standby period may be omitted, and energy consumed by the fusing apparatus is thereby substantially reduced.

A temperature and a heat-up rate of the resistive heating layer 313 may determined by geometric dimensions, e.g., a thickness and a length, of the resistive heating layer 313, and material characteristics, e.g., specific heat and electric conductivity, of the resistive heating layer 313. In an embodiment, the electric conductivity of the resistive heating layer 313 may be greater than or equal to $10^{-5}$ Siemens per meter (S/m). When the resistance of the resistive heating layer 313 is substantially reduced, the heating member 310 is effectively and rapidly heated. Resistance of a resistive material is proportional to a length of the resistive material, and is inverse proportional to the cross section are and the electric conductivity of the resistive material. The electric conductivity of the resistive heating layer 313 may be increased to reduce the resistance of the resistive heating layer 313. The electric conductivity may be increased by increasing the amount of the conductive fillers, improving the arrangement of the conductive fillers or adjusting the dispersion of the conductive fillers. When the amount of the conductive fillers is increased, the mechanical properties of the resistive heating layer 313 deteriorate, and the durability of the heating member 310 is thereby decreased.

By reducing contact resistance between the electrodes 331 and 332 and the resistive heating layer 313, current supplied into the resistive heating layer 313 may be increased. In an embodiment, when the contact resistance between the electrodes 331 and 332 and the resistive heating layer 313 increases, lower voltage is applied to the resistive heating layer 313 due to the contact resistance. Accordingly, the voltage applied to the resistive heating layer 313 is lower than a voltage applied between the electrodes 331 and 332, and thus a current supply amount decreases.

As shown in FIG. 3, the heating member includes a contacting unit 313*a*, and the electrodes 331 and 332 in contact with the contacting unit 313*a*. The contacting unit 313*a* is formed by removing a portion of the surface of the resistive heating layer 313. Referring to FIG. 4, a reference numeral S1 refers the surface level of the resistive heating layer 313 before a portion of the surface is removed, and reference numeral f refers to conductive fillers disposed in the resistive heating layer 313, e.g., reference numerals f1, f2, f3, f4, f5 and f6 refer a first conductive filler, a second conductive filer, a third conductive filler, a fourth conductive filler, a fifth conductive filler and a sixth conductive filler, respectively. Since a conductive filler, e.g., the fourth conductive filler f4, is exposed on the surface S1, the exposed conductive filler, e.g., the fourth conductive filler f4, contacts the electrodes 331 and 332, thereby provides an effective moving path of electrons. In an embodiment, electrons may move between the electrodes 331 and 332 through conductive fillers disposed substantially adjacent to the surface level S1 of the resistive heating layer 313, e.g., the second conductive filler f2, the third conductive filler f3 and the fifth conductive filler f5, according to a tunnel effect. In an embodiment, conductive fillers disposed substantially apart from the surface level S1 of the resistive heating layer 313, e.g., the first conductive filler f1 and the sixth conductive filler f6, may not be used as an effective moving path of the electrons. When the number of conductive fillers through which electrons may not move between the electrodes 331 and 332, e.g., the first conductive filler f1 and the sixth conductive filler f6, increases, the contact resistance between the electrodes 331 and 332 and the resistive heating layer 313 increases, and thus the current supplied to the resistive heating layer 313 decreases.

Referring again to FIG. 4, a reference numeral S2 refers a surface level of the contacting unit 313*a* formed by removing a portion of the surface of the resistive heating layer 313. Due to the surface level S2 of the contacting unit 313*a* lowered from the surface level S1 of the resistive heating layer 313, the conductive fillers disposed relatively adjacent to the surface level S1 of the resistive heating layer 313, e.g., the second conductive filler f2, the third conductive filler f3 and the fifth conductive filler f5, become effective moving paths of electrons by contacting the electrodes 331 and 332, and the conductive fillers disposed relatively apart from the surface level S1 of the resistive heating layer 313, e.g., the first conductive filler f1 and the sixth conductive filler f6, may become an effective moving path of electrons according to a tunnel effect. In an embodiment, the contact resistance between the electrodes 331 and 332 and the resistive heating layer 313 is substantially reduced when the contacting unit 313*a* is formed by removing a portion of the surface of the resistive heating layer 313, because the number of conductive fillers that operate as the effective moving paths of electrons is substantially increased by increasing the number of conductive fillers in contact with the surface S2 of the contacting unit 313*a* or disposed substantially adjacent to the surface S2 of the contacting unit 313*a* to be an effective moving path of electrons according to a tunnel effect. Accordingly, the voltage drop due to the contact resistance between the electrodes 331 and 332 and the resistive heating layer 313 is effectively prevented, and the amount of current supplied to the resistive heating layer 313 is thereby substantially increased.

The contacting unit 313*a* may be formed by removing a portion of the surface of the resistive heating layer 313 using various methods including, for example, a mechanical polishing method, a chemical mechanical polishing method, a wet chemical etching method, an electrochemical etching method, or a dry plasma etching method, but not being limited thereto. In an embodiment, when a chemical etching method is used, a solvent may be selected based on solubility and reactivity of the base material of the resistive heating layer 313. In an embodiment, the solvent used for the chemical etching method may be toluene, acetone, methanol, xylene, benzene, pentane, hexane, dimethyl carbonate, ethyl acetate, chloroform, triethylamine, tetrahydrofuran ("THF"), or dimethylformamide ("DMF"). In another embodiment, the solvent may be an acid, such as an acetic acid, ammonium hydroxide, a chloroacetic acid, dipropylamine, a hydrochloric acid, a nitric acid, a phosphoric acid, potassium hydroxide, sodium hydroxide, a sulfuric acid or a trifluoroacetic acid ("TFA"), for example. An etching time and concentration of the solvent may be adjusted based on an etching speed or etching thickness during the chemical etching process.

In an experiment, an example embodiment of a first resistive heating layer is prepared by dispersing 1 weight (wt) percent (%) of single wall carbon nanotubes ("SWNT") in PDMS constituting a base material, and an example embodiment of a second resistive heating layer is prepared by dispersing 2 wt % of SWNT in PDMS constituting a base material. The electric conductivities of the first and second resistive heating layer are measured by connecting an electrode to each of the surfaces of the first and second resistive heating layer. Then, the surfaces of the first and second resistive heating layer are chemically etched by using 99% concentration TFA as a solvent, and the electric conductivities of the first and second resistive heating layer are measured by connecting an electrode to each of the etched surfaces of the first and second resistive heating layer. As shown in Table 1 below, the electric conductivities of the first and second resistive heating layer are higher when the surfaces of the first and second resistive heating layer are etched, because the amount of SWNT exposed on the surface after etching is greater than the amount of SWNT exposed on the surface before etching.

TABLE 1

| SWNT [wt %] | Solvent | Etching Time [sec] | Electric Conductivity before Etching [S/m] | Electric Conductivity after Etching [S/m] | Change of Electric Conductivity [%] |
|---|---|---|---|---|---|
| 1 | TFA (99%) | 10 | 0.58 | 1.27 | 119.0 |
| 1 | TFA (99%) | 30 | 0.55 | 1.69 | 207.3 |

TABLE 1-continued

| SWNT [wt %] | Solvent | Etching Time [sec] | Electric Conductivity before Etching [S/m] | Electric Conductivity after Etching [S/m] | Change of Electric Conductivity [%] |
|---|---|---|---|---|---|
| 1 | TFA (99%) | 60 | 0.55 | 2.25 | 309.9 |
| 2 | TFA (99%) | 10 | 1.65 | 2.22 | 34.4 |
| 2 | TFA (99%) | 30 | 1.78 | 2.49 | 40.0 |
| 2 | TFA (99%) | 60 | 2.22 | 3.76 | 69.1 |

In another experiment, an example embodiment of a resistive heating layer is prepared by dispersing 2 wt % SWNT in PDMA constituting a base material, and then a contact resistance, a transfer length, and a specific contact resistance of the resistive heating layer are measured. The surface of the resistive heating layer is chemically etched for about 1 minute by using 99% concentration TFA as a solvent. Then, the contact resistance, the transfer length, and the specific contact resistance of the etched resistive heating layer are measured. As shown in Table 2 below, the contact resistance and the specific contact resistance when the chemical etching is performed are lower and the transfer length is shorter than the contact resistance and the specific contact resistance when the chemical etching is not performed. In the experiment, a 2×12 millimeters (mm) silver (Ag) electrode was used to measure the electric conductivity, the contact resistance, the transfer length, and the specific contact resistance.

TABLE 2

| SWNT [wt %] | TFA Treatment | Contact Resistance [Ω] | Transfer Length [mm] | Specific Contact Resistance [Ω/cm$^2$] |
|---|---|---|---|---|
| 2 | No | 39.08 | 0.89 | 4.15 |
| 2 | Yes | 10.37 | 0.45 | 0.56 |

In an embodiment, the contacting unit 313*a* may be formed using the polishing or etching methods described above after forming the insulation layer 312 and/or the resistive heating layer 313 on the circumference of the base 311. In another embodiment, the contacting unit 313*a* may be formed on the resistive heating layer 313 formed in the shape of a tube by using the polishing or etching method, and then the resistive heating layer 313 formed in the shape of a tube and on which the contacting unit 313*a* is formed may be inserted into the base 311 or the insulation layer 312. In another embodiment, the resistive heating layer 313 formed in the shape of a tube be inserted in the base 311, the insulation layer 312 may be formed by supporting the circumference of the resistive heating layer 313 with a mold and inserting an insulation material between the resistive heating layer 313 and the base 311, and then forming the contacting unit 313*a* by etching the outside surface of the resistive heating layer 313 by using the polishing or etching method. However, a method of preparing the heating member 310 is not limited to the methods described above.

The amount removed from the surface of the resistive heating layer 313 to form the contacting unit 313*a*, e.g., a polishing amount of the polishing method or an etching amount of the etching method, may be determined based on the composition of the resistive heating layer 313 and a shape and a type of the conductive filler. In an embodiment, the polishing or etching amount may be equal to or greater than a thickness through which a tunnel effect may occur. In an embodiment, the polishing or etching amount may be greater than or equal to about 10 nanometers (nm), or the height of the cut-out surface of the resistive heating layer 313 after the polishing or etching may be equal to or greater than about 10 nm. In an embodiment, when a chemical etching method is used, concentration of a solvent and an etching time may be adjusted such that the etching amount is equal to or greater than 10 nm. Accordingly, the amount of conductive fillers that operate as effective moving paths of electrons may be substantially increased by increasing the number of the conductive fillers exposed on the surface of the contacting unit 313*a* or by increasing the number of the conductive fillers from which electrons may be moved to a electrodes contacting the conductive fillers according to a tunnel effect.

In an embodiment, a difference between surface roughness of the contacting unit 313*a* formed by polishing or etching and the surface roughness of the resistive heating layer 313 before the polishing or etching may be equal to or greater than 10 nm. The surface roughness after the polishing or etching may be greater or lesser than the surface roughness before the polishing or etching, because when the surface roughness before the polishing or etching is substantially large, e.g., when the outside surface of the resistive heating layer 313 is rough, the surface roughness may be decreased due to the polishing or etching, or because when the surface roughness before the polishing or etching is small, e.g., when the outside surface of the resistive heating layer 313 is smooth, the surface roughness may be increased due to the polishing or etching. [NOTE: please note that detailed definition of the surface roughness (which is included in claims) is not included in the specification. It might be rejected as indefinite since a measure surface roughness of a same surface may vary according to, e.g., parameterization and/or measurement instruments.]

In an embodiment, the contact resistance between the electrodes 331 and 332 and the resistive heating layer 313 may be decreased by increasing the number of conductive fillers operating as effective moving paths of electrons between the electrodes 331 and 332 by removing a portion of the outside surface of the resistive heating layer 313. Accordingly, by increasing current supplied to the resistive heating layer 313, the heating temperature and/or the heating rate of the resistive heating layer 313 is substantially increased.

Figure 5:
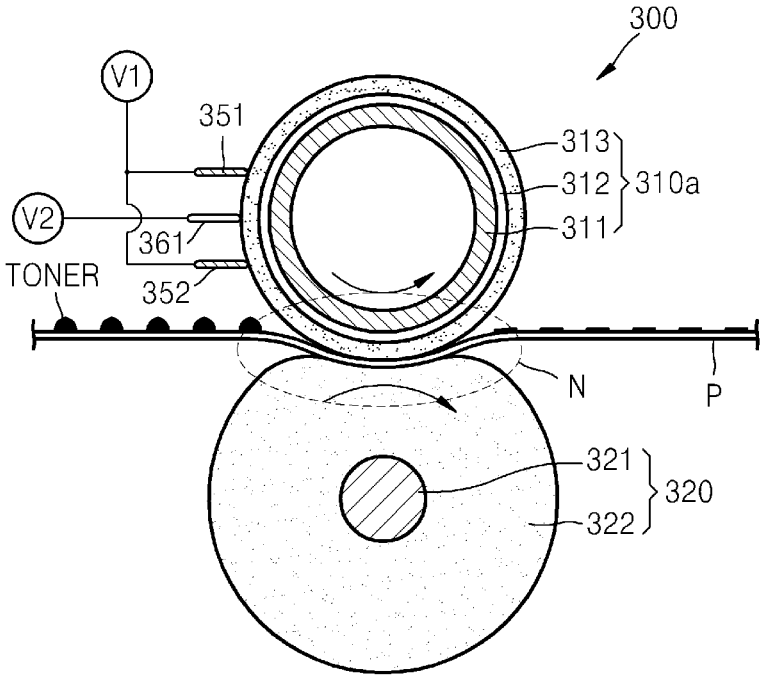
FIG. 5 is a cross-sectional view of another embodiment of a fusing apparatus of the image forming apparatus shown in FIG. 1.
Figure 6:
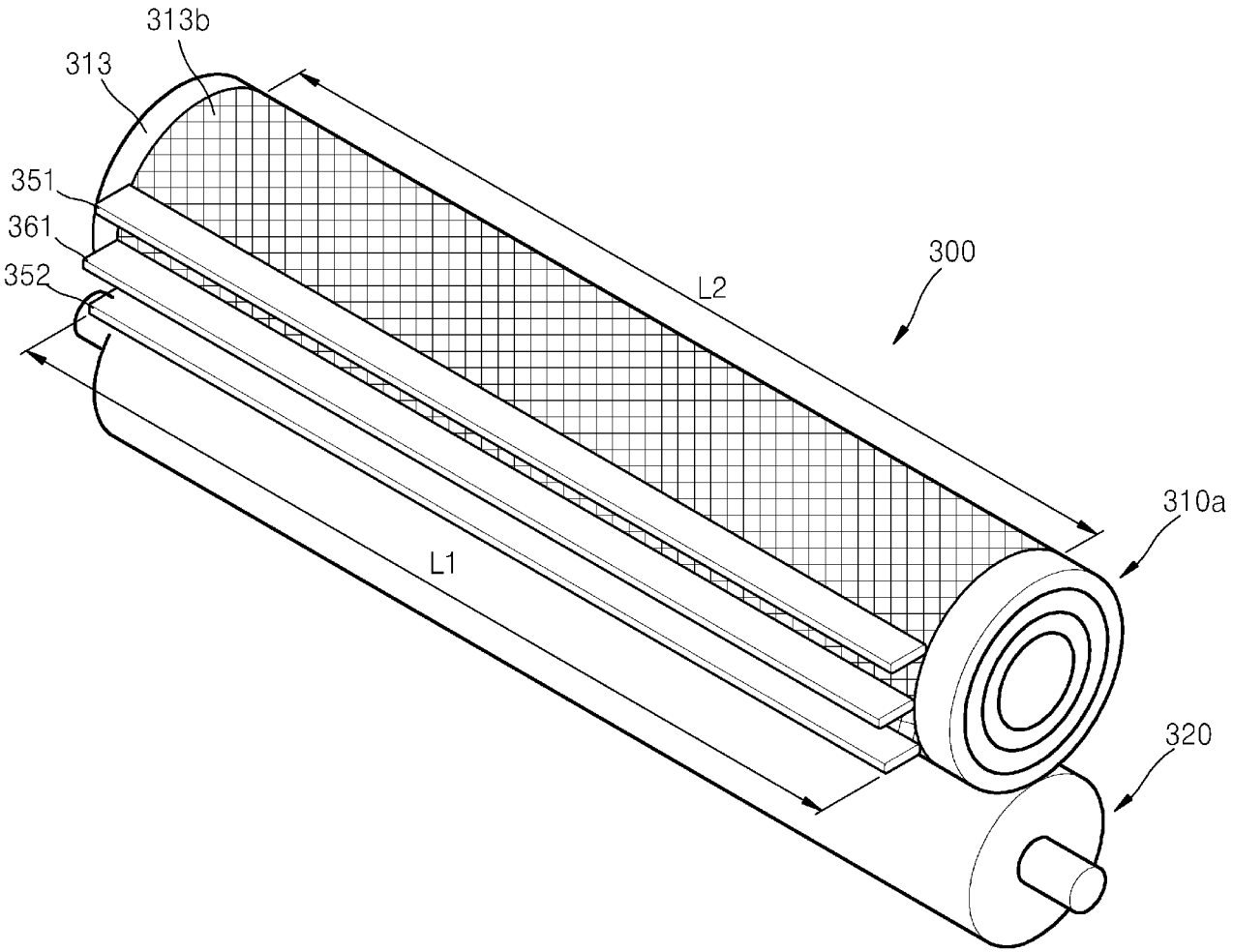
FIG. 6 is a perspective view of the fusing apparatus shown in FIG. 5.
Figure 7:
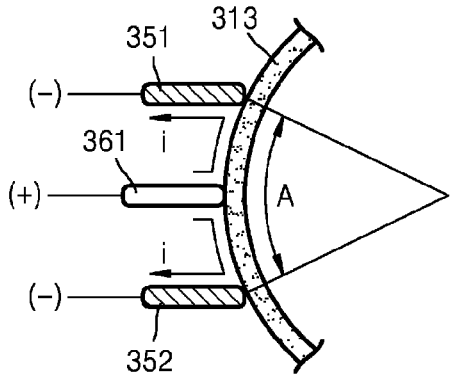
FIG. 7 is an enlarged view of a heating portion of the fusing apparatus shown in FIG. 5.

FIG. 5 is a cross-sectional view of another embodiment of a fusing apparatus, FIG. 6 is a perspective view of the fusing apparatus shown in FIG. 5, and FIG. 7 is an enlarged view of a heating portion of the fusing apparatus shown FIG. 5.

As shown in FIGS. 2 and 3, the contacting unit 313*a* is disposed at least one of end portions of the heating member 310, but the location and shape of the contacting unit 313*a* are not limited thereto. In another embodiment, as shown in FIGS. 5 through 7, electrodes, e.g., a first and second boundary electrodes 351 and 352, and a potential difference forming electrode 361, having a length L1 corresponding to a width of the printing medium, e.g., a width of the sheet of paper P, may be used as current supply electrodes that supply a current to the resistive heating layer 313. Accordingly, the current flows in a circumference direction of the resistive heating layer 313, and thus the current flows along a substantially short current path in the resistive heating layer 313. By shortening a current path, the electric resistance of the resistive heating layer 313 is substantially reduced. A material having low electric conductivity may be used to form the resistive heating layer 313 because when the electric resistance of the resistive heating layer 313 is substantially low, the amount of current supplied to of the resistive heating layer 313 increases. In an embodiment, a material having excellent mechanical properties and a low electric conductivity may be used to form the resistive heating layer 313 due to reduced electric resistance of the resistive heating layer 313 by shortening a current path in the resistive heating layer 313. The electrodes, e.g., the first and second boundary electrodes 351 and 352, and the potential difference forming electrode 361, contact the surface of the resistive heating layer 313. In an embodiment, when heat is generated in the resistive heating layer 313, the heat loss of the heat supplied to the fusing nip N is substantially low e.g., as low as a heat loss of a heat supplied to the fusing nip N when the heat is generated in the base 311.

In an embodiment, as shown in FIG. 6, the fusing apparatus 300 includes the heating member 310*a* including a contacting unit 313*b* formed by removing a portion of the surface of the resistive heating layer 313 using a polishing or etching method. The first and second boundary electrodes 351 and 352 and the potential difference forming electrode 361 may contact the contacting unit 313*b*. The length L1 of the contacting unit 313*b* may be equal to or greater than a length L2 of the electrodes 351, 352, and 361.

In an embodiment, the first and second boundary electrodes 351 and 352 are disposed apart from each other in a moving direction of the heating member 310*a*, e.g., a rotating direction of the heating member 310*a*, and contact the contacting unit 313*b*. The first and second boundary electrodes 351 and 352 may receive a same electric potential, e.g., a first electric potential V1. The potential difference forming electrode 361 is disposed between the boundary electrodes 351 and 352, and contacts the contacting unit 313*b*. The potential difference forming electrode 361 may receive a second electric potential V2 different from the electric potential V1. Accordingly, a potential difference is generated between the potential difference forming electrode 361 and the first boundary electrode 351, and between the potential difference forming electrode 361 and the second boundary electrode 352, and a current thereby flows along the surface of the resistive heating layer 313. In an embodiment, as shown in FIG. 7, when a same negative (−) electric potential is applied to the first and second boundary electrodes 351 and 352 and a positive (+) electric potential is applied to the potential difference forming electrode 361, a current i is restricted to the heating portion, e.g., a portion between the first and second boundary electrodes 351 and 352, and flows in a region A where the potential difference forming electrode 361 is disposed. Since the electric potential at the first and second boundary electrodes 351 and 352 are the same, a potential difference is not generated in other regions aside from the region A, and thus the current i does not flow in the other regions. Heat is generated in the region A according to the current i flowing in circumference directions on the surface of the resistive heating layer 313. As the heating member 310*a* rotates, the heated region A reaches the fusing nip N, and the heat is transferred from the circumference of the resistive heating layer 313 to the printing medium, e.g., the sheet of paper P, and the toner disposed on the printing medium, e.g., the sheet of paper P, according to electrostatic force.

In an embodiment, the boundary electrodes 351 and 352 and the potential difference forming electrode 361 may be disposed in a way that the current i flows in circumference directions along the surface of the resistive heating layer 313, and the resistance due to the resistive heating layer 313 is substantially reduced. In an embodiment, the heating member 310*a* includes the contacting unit 313*b*, and contact resistance between the boundary electrodes 351 and 352 and the potential difference forming electrode 361 is thereby substantially reduced. Accordingly, the heating member 310*a* emits heat effectively rapidly under a determined amount of the conductive fillers. The amount of the conductive fillers of the resistive heating layer 313 may be determined based on heating characteristics of the resistive heating layer 313 and mechanical properties of, e.g., hardness, tensile strength and compression strength, of the resistive heating layer 313. In an embodiment the amount of the conductive fillers of the resistive heating layer 313 may be determined such that heating characteristics of the resistive heating layer 313 and the mechanical properties, e.g., hardness, tensile strength and compression strength, of the resistive heating layer 313 are substantially improved. In an embodiment, the heat generated in the resistive heating layer 313 is transferred to the fusing nip N through the surface of the resistive heating layer 313, and thus the amount of heat lost of heat transferred to the base 311 is substantially reduced and the thermal efficiency is thereby substantially increased. In an embodiment, heat is generated in the heating portion of the resistive heating layer 313, and thus the temperature of the heating portion is rapidly increased. Accordingly, the fusing apparatus 300 may rapidly fuse the toner on the printing medium, e.g., the sheet of paper P. In an embodiment, electrodes that supply a current to the resistive heating layer 313 may be separated from the heating member 310*a*, and the structure of the heating member 310*a* is thereby simplified to be easily manufactured. In an embodiment, resistance due to the resistive heating layer 313 does not substantially vary due to a change of size of the heating member 310*a*, and thus the temperature of the surface of the heating member 310*a* is easily adjusted. In an embodiment, the heating portion does not change due to a change of the diameter of the heating member 310*a* when the distance between the boundary electrodes 351 and 352 is effectively maintained, and the resistance in the heating portion of the resistive heating layer 313 is thereby effectively maintained. In an embodiment, since the fusing nip N of the fusing apparatus 300 contacts the printing medium, e.g., the sheet of paper P, the heating portion may be determined not to overlap the fusing nip N, and an electric shock due to current leakage through the fusing nip Nis thereby effectively prevented.

Figure 8:
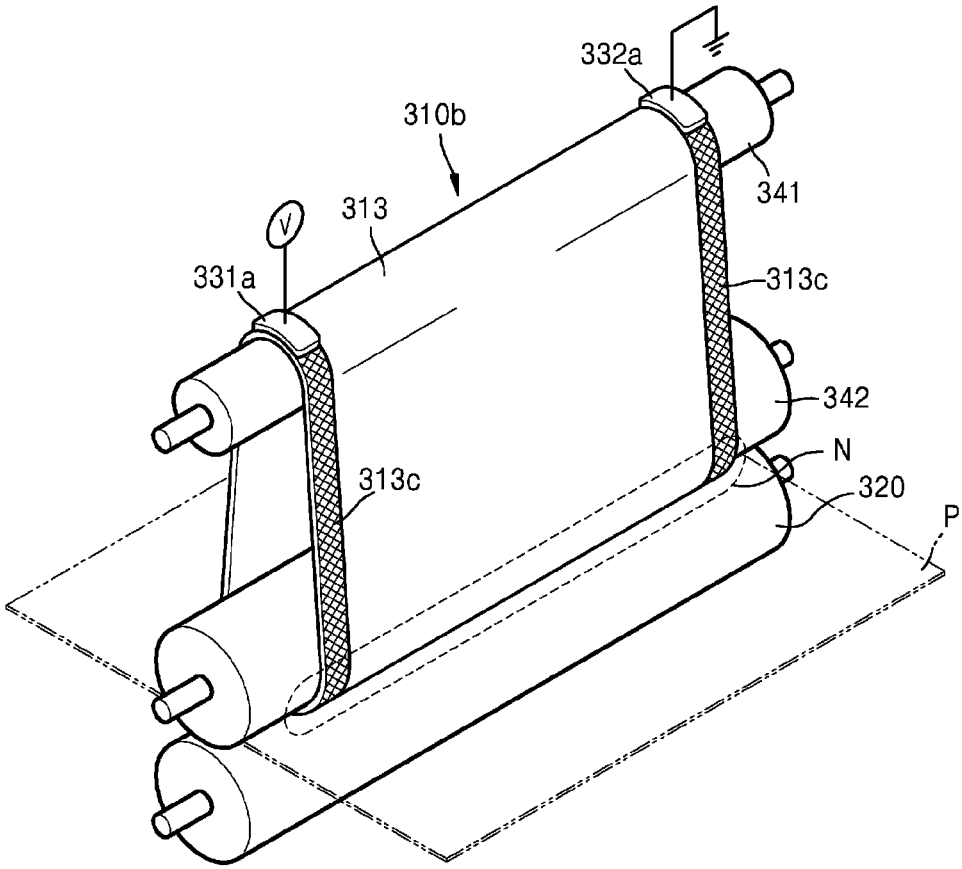
FIG. 8 is a perspective view of another embodiment of a fusing apparatus of the image forming apparatus shown in FIG. 1.
Figure 9:
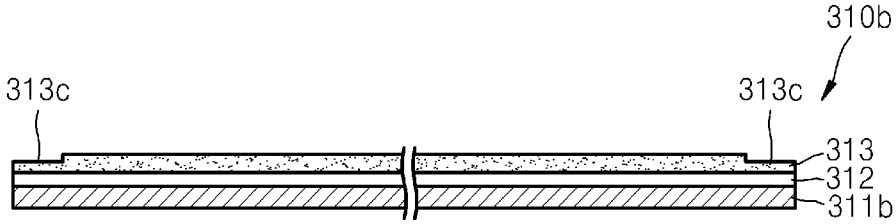
FIG. 9 is a cross-sectional view of a heating member of the fusing apparatus shown in FIG. 8.

FIG. 8 is a perspective view of another embodiment of a fusing apparatus, and FIG. 9 is a cross-sectional view of a heating member of the fusing apparatus shown in FIG. 8.

The heating member 310*b* in FIGS. 8 and 9 is substantially the same as heating member 310 or 310*a* shown in FIGS. 1 through 7 except for the shape thereof. The same or like elements shown in FIGS. 8 and 9 have been labeled with the same reference characters as used above to describe the example embodiments of the heating member 310 or 310*a* shown in FIGS. 1 though 7, and any repetitive detailed description thereof will hereinafter be omitted or simplified. As shown in FIG. 8, the fusing apparatus 300 may include the heating member 310*b* formed in the shape of a belt. Referring to FIG. 9, the heating member 310*b* is supported by first and second supporting rollers 341 and 342, and thereby rotates. The nip forming member 320 forms the fusing nip N by being biased toward the second supporting roller 342, where the heating member 310*b* is disposed between the second supporting roller 342 and the nip forming member 320.

Referring again to FIG. 9, the heating member 310*b* includes a base 311*a* in the shape of a belt and the resistive heating layer 313 disposed on the base 311*a*. The base 311*a* may be substantially flexible such that a portion of the base 311*a* is deformed when the portion of the based 331 is included in the fusing nip N and the deformed portion of the based 311*a* is restored to its original state when the portion of the base 311*a* is not included the fusing nip N, while the based

311*a* is rotating. In an embodiment, the base 311*a* may be formed of a thermostable polymer or a metal thin film, for example. In another embodiment, the base 311*a* may be formed of a stainless steel thin film having a thickness of about 35 micron, for example. The insulation layer 312 may be disposed between the base 311*a* and the resistive heating layer 313. A contacting unit 313*c*, which may be formed by a polishing or etching method, for example, and through which the conductive filler in the resistive heating layer 313 is exposed on the surface thereof, is disposed at each end portion of the resistive heating layer 313. Electrodes 331*a* and 332*a* contact the contacting unit 313*c*. In an embodiment, the electrodes 331*a* and 332*a* is disposed opposite to, e.g., facing, the first supporting roller 341, but the locations of the electrodes 331*a* and 332*a* not being limited thereto. In another embodiment, the electrodes 331*a* and 332*a* may be disposed opposite to, e.g., facing, a portion of the second supporting roller 342 adjacent to the fusing nip N. In another embodiment, the shape of the contacting unit 313*c* and the electrodes 331*a* and 332*a* are not limited to the embodiment shown in FIG. 9. In another embodiment, for example, the contacting unit 313*c* may be formed over the entire end portion of the heating member 310*b*, and the electrodes 331*a* and 332*a* may contact such a contacting unit 313*c*.

Figure 10:
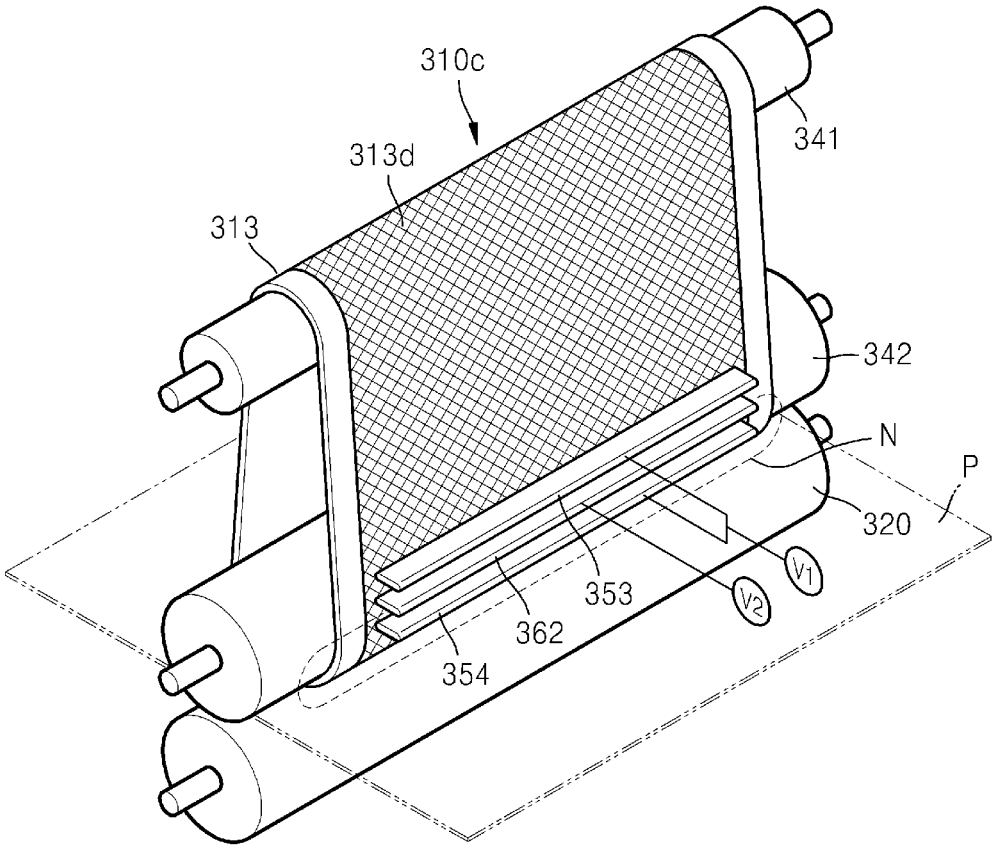
FIG. 10 is a perspective view of another embodiment of a fusing apparatus of the image forming apparatus shown in FIG. 1.

FIG. 10 is a perspective view of another embodiment of a fusing apparatus of the image forming apparatus shown in FIG. 1.

The fusing apparatus 300 illustrated in FIG. 10 is different from the fusing apparatus 300 of FIG. 9, as the fusing apparatus 300 includes boundary electrodes 353 and 354, and a potential difference forming electrode 362 having a length corresponding to a width of the printing medium, e.g., the width of the sheet of paper P, and a heating member 310*c* including a contacting unit 313*d*, formed by a polishing or etching method and through which a conductive filler is exposed, is formed on an outer surface of the resistive heating layer 313. In an embodiment, on a portion of the resistive heating layer 313 corresponding to the length of the boundary electrodes 353 and 354, and the potential difference forming electrode 362. In an embodiment, the boundary electrodes 353 and 354 that define a heating portion of resistive heating layer 313 by contacting the contacting unit 313*d*, and the potential difference forming electrode 362 is disposed between boundary electrodes 353 and 354 and generates a potential difference by contacting the contacting unit 313*d*.

The general inventive concept should not be construed as being limited to the example embodiments set forth herein. Rather, these non-limiting example embodiments are provided so that this disclosure will be thorough and complete and will fully convey the general inventive concept to those skilled in the art.

While the general inventive concept has been particularly shown and described with reference to example embodiments thereof, it will be understood by those of ordinary skill in the art that various changes in form and details may be made therein without departing from the spirit or scope of the present invention as defined by the following claims.

What is claimed is:

1. A heating member comprising:

a resistive heating layer disposed on an outermost layer of the heating member, wherein the resistive heating layer comprises a conductive filler distributed in a base material and wherein the resistive heating layer emits heat when supplied with an electric current from an electrode; and a contacting unit contacts the electrodes, the contacting unit being formed by removing a portion of the surface of the resistive heating layer to expose the conductive filler of the resistive heating layer.

2. The heating member of claim 1, wherein the contacting unit is formed by removing the portion of the surface of the resistive heating layer by using at least one of a mechanical polishing method, a chemical mechanical polishing method, a wet chemical etching method, an electrochemical etching method and a dry plasma etching method.

3. The heating member of claim 2, wherein a thickness of a removed portion of the surface of the resistive heating layer is greater than or equal to about 10 nanometers.

4. The heating member of claim 2, wherein a difference between a surface roughness of the resistive heating layer and a surface roughness of the contacting unit is greater than or equal to about 10 nanometers.

5. The heating member of claim 1, wherein the contacting unit is disposed along an edge portion of the resistive heating layer in a longitudinal direction.

6. The heating member of claim 1, wherein a length of the contacting unit is equal to or greater than a length of the electrode.

7. The heating member of claim 1, further comprising:

a base which supports the resistive heating layer; and an insulation layer disposed between the resistive heating layer and the base, and which insulates the resistive heating layer and the base.

8. A heating member comprising:

a resistive heating layer including a base material and a conductive filler disposed in the base material, wherein a surface of the resistive heating layer includes a cut-out portion; and a contacting unit disposed within the cut-out portion of the surface of the resistive heating layer, wherein the contacting unit exposes the conductive filler and contacts an electrode which supplies a current to the resistive heating layer.

9. The heating member of claim 8, wherein the contacting unit is formed by removing a portion of the surface of the resistive heating layer by using at least one of a mechanical polishing method, a chemical mechanical polishing method, a wet chemical etching method, an electrochemical etching method and a dry plasma etching method.

10. The heating member of claim 9, wherein a difference between a surface roughness of the resistive heating layer and a surface roughness of the contacting unit is equal to or greater than about 10 nanometers.

11. The heating member of claim 8, wherein a cut-out height of the contacting unit with respect to the resistive heating layer is equal to or greater than about 10 nanometers.

12. A fusing apparatus which fuses a toner image on a printing medium, the fusing apparatus comprising:

a heating member comprising:

a resistive heating layer disposed on an outermost layer of the heating member, wherein the resistive heating layer comprises a conductive filler distributed in a base material and wherein the resistive heating layer emits heat when supplied with an electric current from an electrode; and a contacting unit contacts the electrodes, the contacting unit being formed by removing a portion of the surface of the resistive heating layer to expose the conductive filler of the resistive heating layer;

a nip forming member disposed opposite to the heating member and which forms a fusing nip; and an electrode which contacts the contacting unit and supplies a current to the resistive heating layer.

13. The fusing apparatus of claim 12, wherein the contacting unit is formed by removing the portion of the surface of the resistive heating layer by using at least one of a mechanical polishing method, a chemical mechanical polishing method, a wet chemical etching method, an electrochemical etching method and a dry plasma etching method.

14. The fusing apparatus of claim 13, wherein a thickness of a removed portion of the surface of the resistive heating layer is greater than or equal to about 10 nanometers.

15. The fusing apparatus of claim 13, wherein a difference between a surface roughness of the resistive heating layer and a surface roughness of the contacting unit is greater than or equal to about 10 nanometers.

16. The fusing apparatus of claim 12, wherein the contacting unit is formed at each of end portions of the surface of the resistive heating layer along a longitudinal direction of the end portions, and the electrode is disposed substantially adjacent to the heating member and contacting the contacting unit.

17. The fusing apparatus of claim 12, wherein a length of the electrode corresponds to a width of the printing medium, and a length of the contacting unit is equal to or greater than the length of the electrode.

18. The fusing apparatus of claim 17, wherein the electrode is disposed outside the heating member.

19. The fusing apparatus of claim 12, further comprising:

a base which supports the resistive heating layer; and an insulation layer disposed between the resistive heating layer and the base, and which insulates the resistive heating layer and the base.

20. A fusing apparatus which fuses a toner image on a printing medium, the fusing apparatus comprising:

a heating member comprising:

a resistive heating layer including a base material and a conductive filler disposed in the base material, wherein a surface of the resistive heating layer includes a cut-out portion; and a contacting unit disposed within the cut-out portion of the surface of the resistive heating layer, wherein the contacting unit exposes the conductive filler and contacts an electrode which supplies a current to the resistive heating layer;

a nip forming member disposed opposite to the heating member and which forms a fusing nip; and an electrode which contacts the contacting unit and supplies a current to the resistive heating layer.

21. The fusing apparatus of claim 20, wherein the contacting unit is formed by removing a portion of the surface of the resistive heating layer by using at least one of a mechanical polishing method, a chemical mechanical polishing method, a wet chemical etching method, an electrochemical etching method and a dry plasma etching method.

22. The fusing apparatus of claim 21, wherein a difference between a surface roughness of the surface of the resistive heating layer and a surface roughness of the contacting unit is greater than or equal to about 10 nanometers.

23. The fusing apparatus of claim 20, wherein a cut-out height of the contacting unit with respect to the resistive heating layer is greater than or equal to 10 nanometers.

24. An image forming apparatus comprising:

a printing unit which forms a toner image on a printing medium by using an electrophotographic process; and a fusing apparatus which fuses the toner image on the printing medium by using heat and pressure, the fusing apparatus comprising:

a heating member comprising:

a resistive heating layer disposed on an outermost layer of the heating member, wherein the resistive heating layer comprises a conductive filler distributed in a base material and wherein the resistive heating layer emits heat when supplied with an electric current from an electrode; and a contacting unit contacts the electrodes the contacting unit being formed by removing a portion of the surface of the resistive heating layer to expose the conductive filler of the resistive heating layer;

a nip forming member disposed opposite to the heating member and which forms a fusing nip; and an electrode which contacts the contacting unit and supplies a current to the resistive heating layer.

25. An image forming apparatus comprising:

a printing unit which forms a toner image on a surface of a printing medium by using an electrophotographic process; and a fusing apparatus which fuses the toner image on the printing medium by using heat and pressure, the fusing apparatus comprising:

a heating member which comprising:

a resistive heating layer including a base material and a conductive filler disposed in the base material, wherein a surface of the resistive heating layer includes a cut-out portion; and a contacting unit disposed within the cut-out portion of the surface of the resistive heating layer, wherein the contacting unit exposes the conductive filler and contacts an electrode which supplies a current to the resistive heating layer;

a nip forming member disposed opposite to the heating member and which forms a fusing nip; and an electrode which contacts the contacting unit and supplies a current to the resistive heating layer.

* * * * *